US009340387B2

(12) United States Patent
Giuliani

(10) Patent No.: US 9,340,387 B2
(45) Date of Patent: May 17, 2016

(54) APPARATUS AND METHOD FOR SPLICING WEBS PROVIDED WITH REPEATED PATTERNS

(71) Applicant: SIDEL S.p.A. con Socio Unico, Parma (IT)

(72) Inventor: Mattia Giuliani, Parma (IT)

(73) Assignee: SIDEL S.p.A. con Socio Unico (IT)

( * ) Notice: Subject to any disclaimer, the term of this patent is extended or adjusted under 35 U.S.C. 154(b) by 168 days.

(21) Appl. No.: 13/954,358

(22) Filed: Jul. 30, 2013

(65) Prior Publication Data

US 2014/0034772 A1 Feb. 6, 2014

(30) Foreign Application Priority Data

Jul. 31, 2012 (IT) ..... TO2012A0683

(51) Int. Cl.
*B65H 19/00* (2006.01)
*B65H 19/10* (2006.01)
*B65H 19/18* (2006.01)

(52) U.S. Cl.
CPC ..... *B65H 19/102* (2013.01); *B65H 19/1852* (2013.01); *B65H 2301/46013* (2013.01); *B65H 2301/4622* (2013.01); *B65H 2301/4631* (2013.01); *B65H 2301/4641* (2013.01); *B65H 2301/46176* (2013.01); *B65H 2403/513* (2013.01); *B65H 2801/75* (2013.01)

(58) Field of Classification Search
CPC ..... B65H 19/102; B65H 2406/30; B65H 2301/4621
USPC ..... 242/551, 553, 554.2, 554.6, 556.1
See application file for complete search history.

(56) References Cited

U.S. PATENT DOCUMENTS 4,157,934 A * 6/1979 Ryan et al. ..... 156/504
4,331,301 A * 5/1982 Martinez ..... 156/502
4,481,053 A * 11/1984 Tokuno et al. ..... 156/157
5,468,321 A * 11/1995 van Liempt et al. ..... 156/159

(Continued)

FOREIGN PATENT DOCUMENTS

DE 19748614 A1 5/1999
DE 10146448 A1 4/2003

(Continued)

OTHER PUBLICATIONS

"Italian Application Serial No. IT T020120683, Search Report dated May 2, 2013", 7 pgs.

*Primary Examiner* — Sang Kim
(74) *Attorney, Agent, or Firm* — Schwegman, Lundberg & Woessner, P.A.

(57) ABSTRACT

An apparatus for splicing a new web having repeated patterns, to a web in use moving along a predetermined path and also having repeated patterns. The apparatus having: a handling device to advance the new web at the same speed as the web in use and positioning a segment of the new web to overlap a segment of the web in use such that the corresponding patterns align; a cutting device for cutting the overlapping segments of the webs at the area interposed between two successive patterns and dividing each web into an upstream portion and a downstream portion; a folding device for selectively folding either the upstream portion of the web in use and the downstream portion of the new web outside the overlapping area; and an applicator for applying a splicing buffer on the adjacent the cut portions of the two webs to be joined.

14 Claims, 14 Drawing Sheets

(56) References Cited

U.S. PATENT DOCUMENTS

| | | | | |
|---|---|---|---|---|
| 6,923,880 | B2 * | 8/2005 | Keene et al. | 156/159 |
| 2007/0170300 | A1 * | 7/2007 | Titz et al. | 242/552 |

FOREIGN PATENT DOCUMENTS

| | | | |
|---|---|---|---|
| EP | 1209108 | A1 | 5/2002 |
| FR | 2692566 | A3 | 12/1993 |

* cited by examiner 2
2a
3
3a
39
39a
39b
39c
56
56a
56b
56c
57
42
F
23
55
50
58
54
41
51
49
71
47
52
21
40
64
H
73
26
63
18
27
90
89
62
G
66
72
60
88
93
22
91
92
92a
92b
92c
L
P
P1

2
3
2a
3a
24
25
51
F
39
39b
39c
56
56b
56c
39a
56a
42
57
23
55
50
58
54
41
51
49
71
47
52
21
40
64
H
73
26
62
G
66
72
60
88
93
22
63
18
27
90
89
91
L
92
92b
92c
92a
P
P1

F
L
2
2a
3
3a
24
25
28
51
39
39a
39b
39c
56
56a
56b
56c
57
23
42
54
55
50
58
41
52
21
40
62
G
72
28
60
88
93
22
P
P1
47
49
71
64
H
73
26
63
27
18
90
89
91
92
92a
92b
92c

APPARATUS AND METHOD FOR SPLICING WEBS PROVIDED WITH REPEATED PATTERNS

RELATED APPLICATION

This application claims the benefit of priority, under 35 U.S.C. Section 119, to Italian Patent Application Serial No. TO2012A 000683, filed Jul. 31, 2012, which is incorporated herein by reference in its entirety.

The present invention relates to an apparatus and to a method for splicing webs provided with repeated patterns, so as to generate uninterrupted feeding of said webs to a processing machine.

BACKGROUND OF THE INVENTION

As known, the splicing operation of a new web to an almost exhausted web in use is normally carried out without stopping the feeding of the web in use to the labeling machine, but only by slowing its progress.

In particular, a double-sided adhesive sheet element is previously attached upon a head segment of the new web. Said segment of the new web is then made to adhere, thanks to the action of the double-sided adhesive, on a corresponding segment of the web in use so as to obtain alignment of the corresponding labels. Simultaneously to the splicing operation, the web in use is cut in the area located immediately upstream of the segments of the two webs united together by the double-sided adhesive sheet element. It is thus possible to restart the feeding of the labels to the labeling machine at normal speed.

SUMMARY OF THE INVENTION

The method described above presents a number of drawbacks which may result in some cases in the need to stop the labeling machine.

In particular, the double-sided adhesive sheet element not always attaches to both webs; in addition, the acceleration that the two webs undergo after the splicing operation may cause small slippage of one or both webs with respect to the double-sided adhesive sheet, with consequent loss of the initial alignment.

The presence of the double-sided adhesive sheet can also create problems in the moment wherein the labels are mechanically detached from the strip support to be fed to the labeling machine; this operation is normally carried out by sharply making the web change direction, for example making it twist about a bar or thin blade, so as to obtain, during said step, the detachment of the relative label from the support strip; in said situation, the detachment of the double-sided adhesive sheet element may be caused, with the consequences that can be imagined.

Finally, the system described above always determines the overlapping, at least partial, of two labels of the two webs, with the consequent need to discard the containers labeled with said labels.

The present invention relates to an apparatus and to a method for splicing webs provided with repeated patterns, so as to generate uninterrupted feeding of said webs to a processing machine.

In particular, the present invention has advantageous but not exclusive application in the splicing of webs, wherein the different patterns define respective labels intended to be placed on containers, for example bottles or cans, in a labeling machine. In this specific context, the webs may consist entirely in a succession of labels to be separated by a device configured for repeated cutting of the web itself, or they may be constituted by a strip support on which a succession of adhesive labels are applied, also known as "pressure sensitive labels," spaced from each other by predetermined amounts.

The successive description will make explicit reference to this second case (support strip carrying a succession of self-adhesive labels to be detached for the application on respective containers) without loss of generality and said reference should in no way be intended as a limitation of the protection defined by the appended claims.

It is also stated that the present invention may also be applied to the splicing of webs of multilayer packaging material for the production of sealed packages.

An aim of the present invention is to provide an apparatus for splicing webs provided with repeated patterns, which allows to overcome, in a simple and economic way, at least one of the drawbacks associated with the above specified splicing apparatuses of known type.

The above aim is achieved by the present invention, in that it relates to an apparatus for splicing webs provided with repeated patterns.

The present invention also relates to a method for splicing webs provided with repeated patterns.

BRIEF DESCRIPTION OF THE DRAWINGS

For a better understanding of the present invention, a preferred embodiment is next described, purely by way of a non-limiting example and with reference to the accompanying drawings, wherein.

DETAILED DESCRIPTION OF THE INVENTION

Figure 1B:
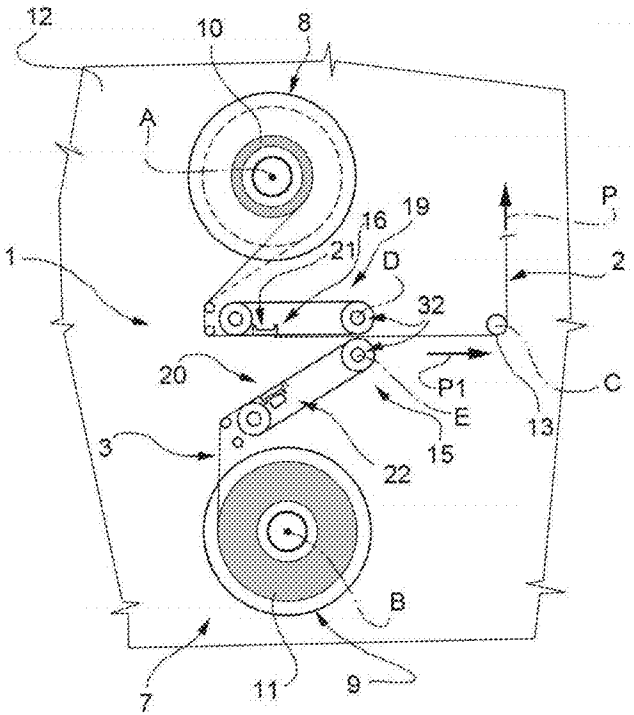
FIGS. 1*a*, 1*b*, 1*c* and 1*d* schematically show a top view of an apparatus for splicing webs made according to the present invention and arranged under different operating conditions within a labeling station for the feeding the labels to be attached on respective containers.
Figure 1A:
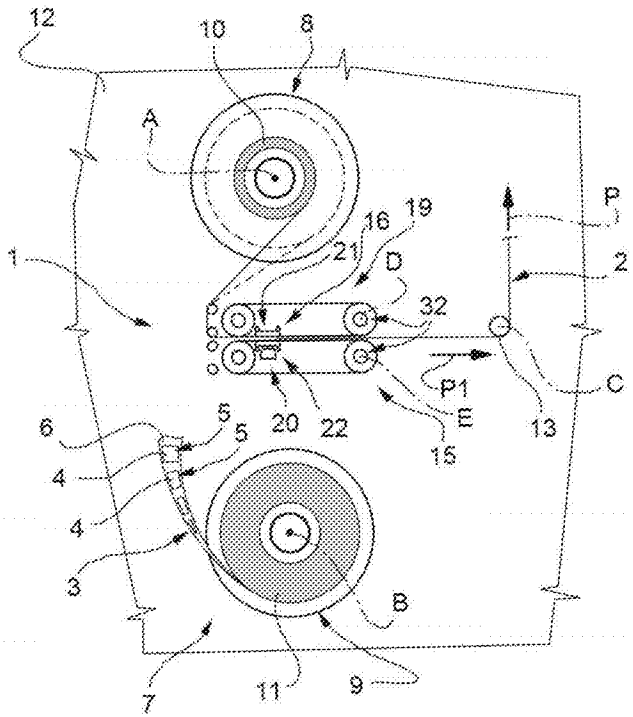
Figure 1D:
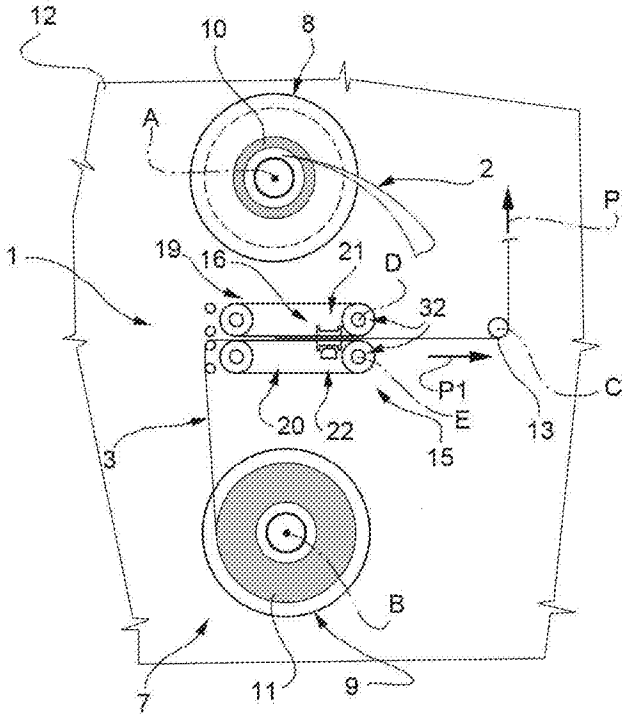

With reference to FIGS. 1*a*, 1*b*, 1*c*, 1*d* and 2, an apparatus for splicing webs 2, 3 is indicated as a whole with 1 which is provided with repeated patterns 4 (FIGS. 2 to 4), so as to generate an uninterrupted feeding of said webs to a processing machine (in itself known and not illustrated).

In particular, the patterns 4 of the webs 2 and 3 define respective labels 5 (FIGS. 1*a*, 2, 3 and 4) intended to be placed on containers (in themselves known and not illustrated), such as bottles or cans, in the cited processing machine, which in this case is constituted by a labeling machine.

In the example herein described and illustrated (FIGS. 1*a*, 2, 3 and 4), the webs 2 and 3 are each constituted by a strip support 6, on which the labels 5, which are thus of self-adhesive type are applied in positions equally spaced to one another.

According to a possible variant not illustrated, the webs 2 and 3 could also be integrally formed by a succession of labels to be separated by repeated cutting of the webs themselves.

According to another possible, non illustrated embodiment of the present invention, the webs 2, 3 could also be formed by a multilayer packaging material adapted to be folded, welded and cut out for achieving sealed packages, for example containing pourable food products.

With particular reference to FIGS. 1*a*, 1*b*, 1*c* and 1*d*, the device 1 is suitable to be integrated into a labeling station 7 (in itself known and only partially shown) for the feeding of the labels 5 to respective containers carried and fed by the labeling machine previously mentioned.

In FIGS. 1*a*, 1*b*, 1*c* and 1*d*, the labeling station 7 is illustrated limited to the components necessary to the understanding of the present invention. In particular, in said figures, two support and unwinding assemblies 8, 9 of respective reels 10, 11 are visible, from which originate the respective webs 2 and 3, and an horizontal table 12 on which the assemblies 8, 9 themselves are placed, in predetermined positions and facing each other.

In FIGS. 1*a*, 1*b*, 1*c* and 1*d* a motorized roller 13 is also visible for the driving, along a predetermined path P, of the web intended to be fed to the processing machine, i.e., depending on the cases, the web 2 or the web 3 or the webs 2 and 3 in the time interval during which they are spliced and then both fed to the processing machine; as shown in FIGS. 1*a*, 1*b*, 1*c* and 1*d*, the path P extends parallel to the table 12.

The reels 10, 11 have respective vertical axes A, B, perpendicular to the table 12, and the roller 13 also has a vertical C axis, parallel to the axes A and B; the webs 2, 3 are then placed orthogonal to the table 12.

It should be noted that, in the illustrated example, the web 2, unwound from the reel 10, represents the web in use fed to the labeling machine, while the web 3, unwound from the reel 11, represents the new web that must be spliced to the web 2 before the exhaustion of the latter. It is obvious that once the splicing is done and the empty reel 10 is extracted, on the previous support and unwinding assembly 8 a new reel (not shown) will be placed, whose web will represent the new web to be spliced to the web 3 when the latter will be almost exhausted.

The device 1 is supported by the table 12 in an interposed position, with reference to the path P, between the roller 13 and the support and unwinding assemblies 8, 9.

With reference to FIGS. 2, 3, 4, 5, 6, 7, 8 and 9, the device 1 comprises essentially:

- a support assembly 15 mounted on the table 12;
- a handling assembly 16 carried by the support assembly 15 and which can be selectively activated just before the exhaustion of the reel 10 in use to feed the new web 3 at the same speed of the web 2 in use and in a position where it has its own segment 3*a* overlapping a segment 2*a* of web 2 itself with the corresponding labels 5 aligned; and
- an actuator assembly 18 (FIGS. 5, 6, 7, 8 and 9) which can be selectively activated to attach the web 3 to the web 2 in correspondence of the overlapping segments 2*a*, 3*a* and during the simultaneous advancement of webs 2, 3 themselves along the path P.

Preferably, the path P has a straight progress in the crossing area of the device 1, resulting parallel to the table 12 and orthogonal to the axes A, B and C; the segment of path P passing through the device 1 will be indicated in the following with the reference P1.

The support assembly 15 comprises essentially two carrying structures 19, 20, arranged on opposite sides of segments 2*a*, 3*a* to be spliced to webs 2 and 3, and the handling assembly 16 comprises two carriages 21, 22 carried by respective structures 19, 20, movable with respect thereof in a direction parallel to the segment P1 of path P and adapted to cooperate on opposite sides with the respective overlapping segments 2*a*, 3*a* of the webs 2 and 3 to keep them attached to one another during the advancement along the path P and allow the actuator assembly 18 to carry out the splicing operation.

As clearly shown in the attached figures, the structure 19 and the carriage 21 are arranged on the side of the web 2 and the reel 10, while the structure 20 and the carriage 22 are arranged on the side of the web 3 and the reel 11.

As will be explained in detail below, each carriage 21, 22 is arranged to allow the hooking of the head end of the new web to be spliced to the web in use, when, as in the example shown, the new web is represented by the web 3 unwound by the reel 11, in turn arranged on the support and unwinding assemblies 9, the head end of said web is hooked on the carriage adjacent to the assembly 9 itself, in this case, the carriage 22; alternatively, if the new web were to be constituted by the web 2 unwound from the reel 10, in turn arranged on the support and unwinding assembly 8, the head end of said web would be hooked to the carriage adjacent to the assembly 8 itself, i.e. to the carriage 21.

Advantageously, the actuator assembly 18 is mounted onto the carriages 21, 22 and comprises:

- cutting device 23 (FIGS. 5, 6, 6*a*, 7, 7*a*, 8, 8*a*, 9 and 9*a*) which can be selectively activated to perform, in correspondence of the area interposed between two successive labels 5, an operation of cutting the overlapping segments 2*a*, 3*a* of the webs 2, 3, so as to divide each web 2, 3 into two separate portions 24, 25 arranged respectively upstream and downstream of the cutting area with reference to the path P;
- folding device 26 (FIGS. 5, 6, 7, 8 and 9) which can be selectively activated to fold, near the cutting area, one of the upstream portion 24 of the web in use and the downstream portion 25 of the new web, in the example shown the downstream portion 25 of the new web 3, outside the overlapping area between the webs 2 and 3, and
- applicator device 27 (FIGS. 5, 6, 7, 8 and 9) movable orthogonally to the path P and parallel to the table 12 to apply a splicing self-adhesive buffer 28 on the adjacent ends of the downstream portion 25 of the web in use, in the example shown the web 2, and of the upstream portion 24 of the new web, in the example shown the web 3, in order to connect together said ends head to head, i.e. without any overlapping between the ends themselves.

As shown in FIGS. 1*a*, 2, 3 and 4, the labels 5 are fixed on the strip-shaped support 6 of the two webs 2, 3 from the side facing the carriage 22.

The buffer 28 consists of a sheet element having a self-adhesive face adapted to be fixed on the adjacent ends of the web supports 6 of the webs 2, 3 from the side opposite to that on which extend the labels 5; also, in the example shown, the buffer 28 is fixed on the webs 2, 3 so as to extend between two successive labels 5.

Preferably, the cutting device 23 are carried by the carriage 21, while the folding device 26 and the applicators 27 are carried by the carriage 22.

Therefore, the folding device 26 may act only on the web 3 facing the carriage 22 and not on the web 2 arranged on the opposite side of the web 3 itself; when the new web is represented, as in the example shown, from the web 3, the folding device 26 are activated to fold the downstream portion 25 of the web 3 itself outside the cutting area; instead, when the new web is represented by the web 2, the folding device are activated in order to fold the upstream portion 24 of the web 3 outside of the cutting area. In this way, whichever being the positioning of the new reel with respect to the carriage 22, it is always possible for the applicator 27 to connect, by way of the buffer 28, the downstream portion 25 of the web in use with the upstream portion 24 of the new web. In practice, the portion of the web adjacent to the folding device 26 that is not needed to make the connection between the webs 2 and 3 is always folded.

According to a possible alternative not shown, the folding device 26 may also be carried by the carriage 21, in this case, the folding device 26 may act only on the web 2 facing the carriage 21 and not on the web 3 arranged on the opposite side of the web 2 itself; so, even in this case, the upstream portion 24 of the web 2 would be folded, when said web would represent the web in use, and the downstream portion of the web 2 itself, when this latter would represent the new web.

Figure 2:
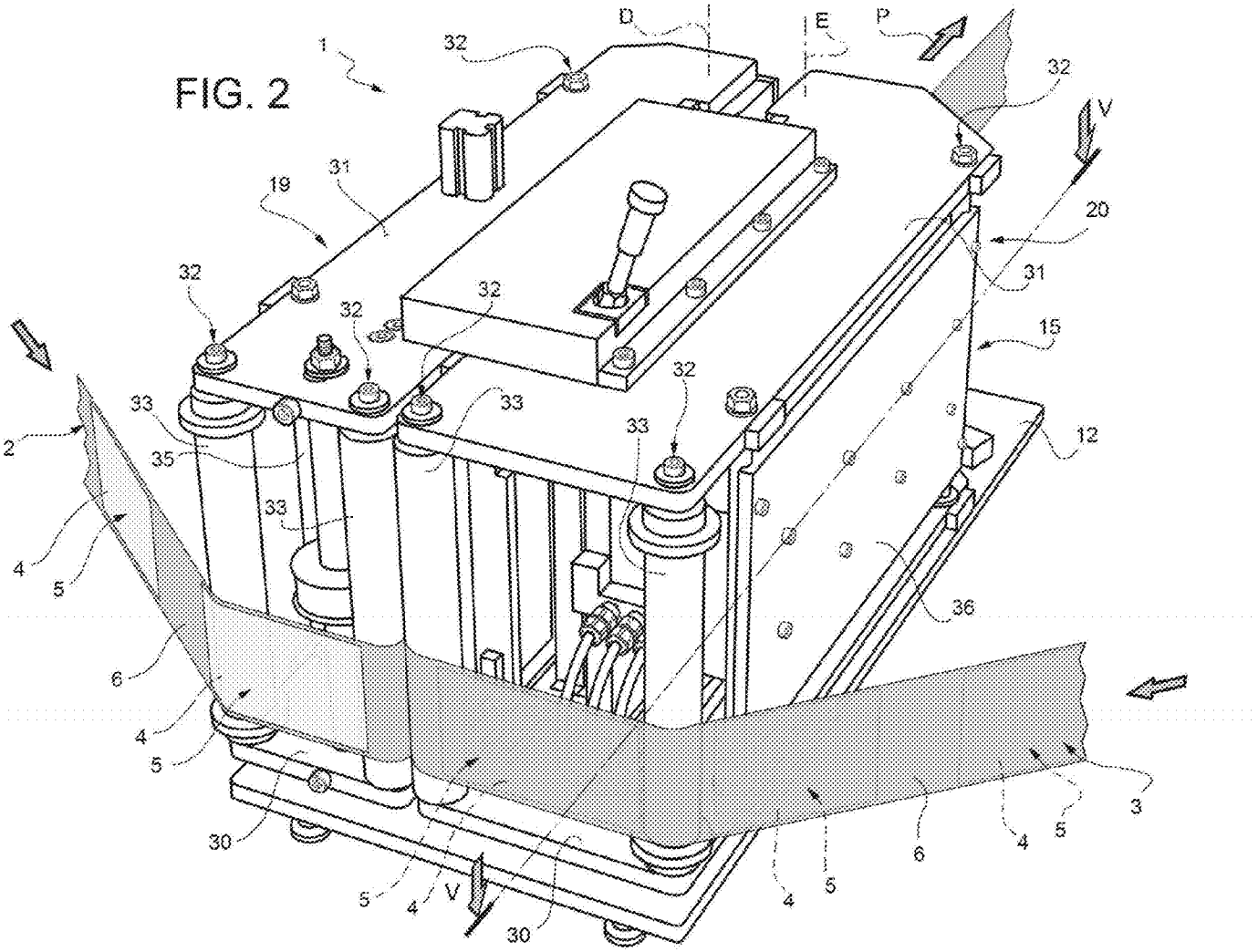
FIG. 2 illustrates, in perspective view and on an enlarged scale, the splicing device of figures from 1*a* to 1*d;*
Figure 3:
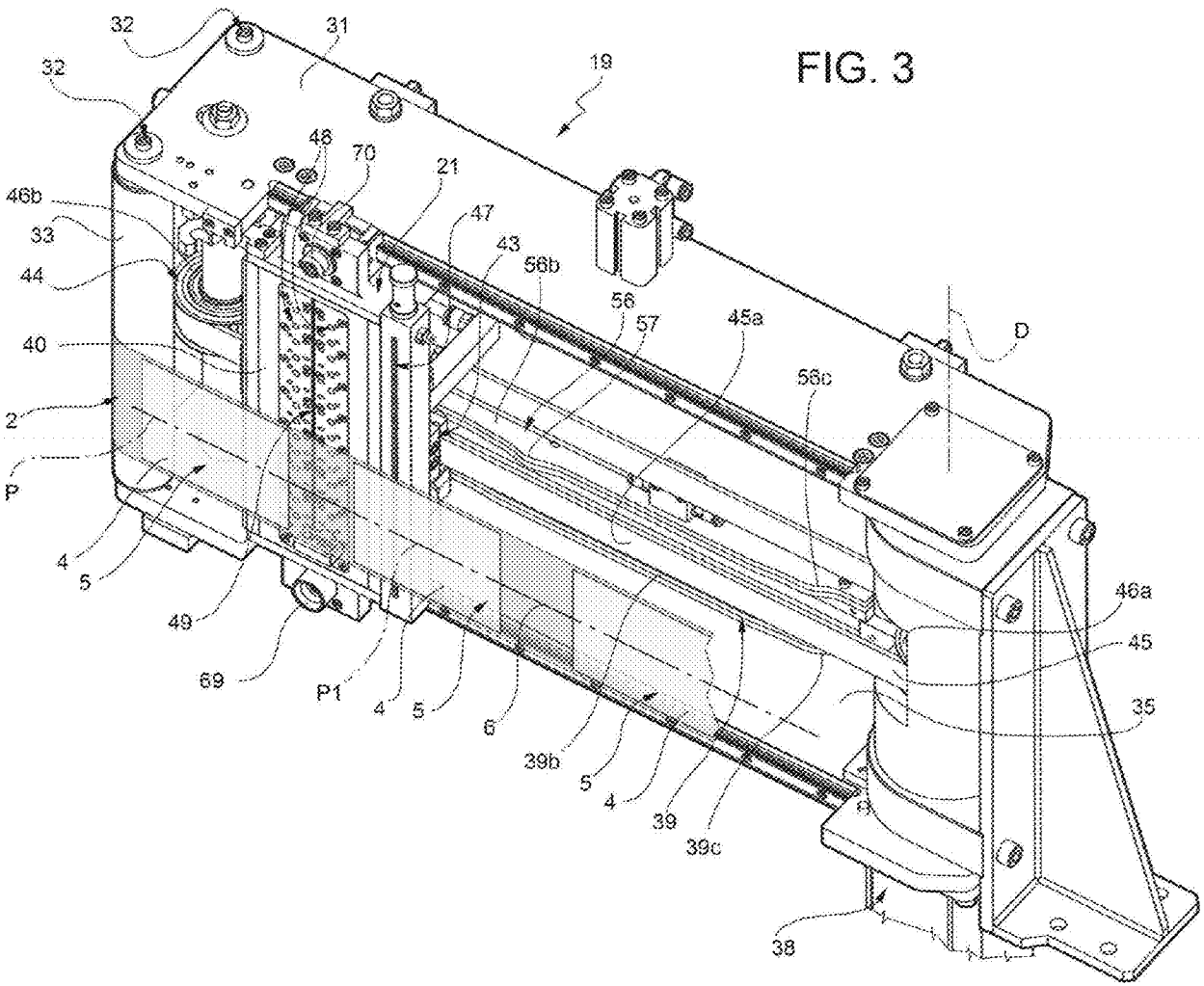
FIG. 3 illustrates, in a perspective view and on an enlarged scale, a first component of the splicing device of FIG. 2.
Figure 4:
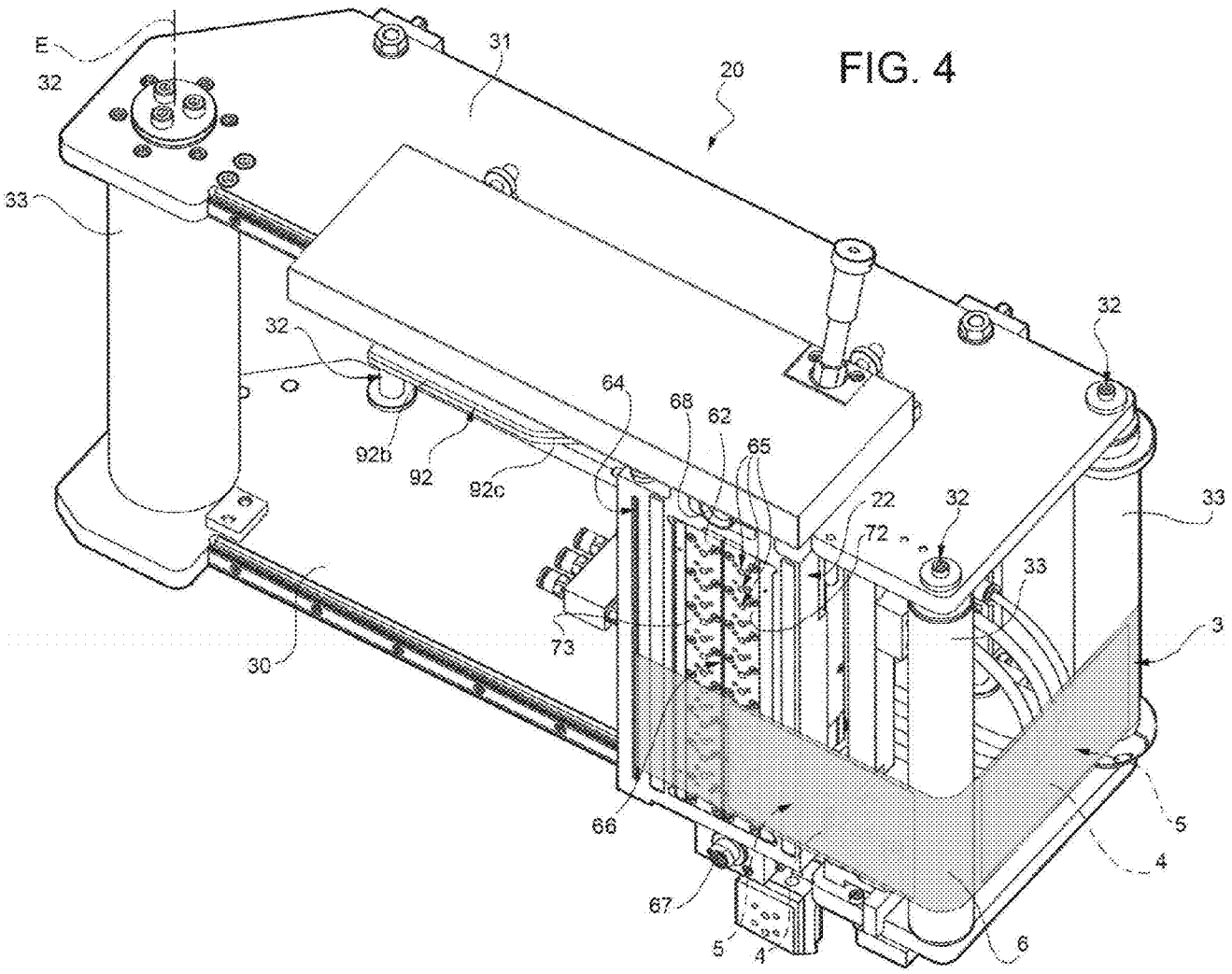
FIG. 4 illustrates, in a perspective view and on an enlarged scale, a second component of the splicing device of FIG. 2.

With particular reference to FIGS. 2, 3 and 4, each structure 19, 20 essentially comprises a base plate 30 mounted horizontally on the table 12, a top plate 31 extending parallel to the plate 30, and a plurality of vertical uprights extending between the plates 30 and 31. On uprights 32 arranged at the upstream end of respective structures 19, 20 with reference to the path P (two uprights 32 for each structure 19, 20) are rotatably mounted on respective rollers 33 for guiding respective webs 2, 3 by the respective coils 10, 11 to the motorized roller 13. The rollers 33 having axes parallel to axis C of the roller 13.

The structures 19, 20 are hinged constrained on the table 12 about respective uprights 32 of axes D, E arranged at the downstream end of the structures 19, 20 themselves with reference to path P. The axes D, E are obviously parallel to the axes A, B and C. Thanks to said hinge constraint, each structure 19, 20 can rotate on the table 12 about the relative axis D, E away from the other structure 20, 19, so as to allow, when necessary, the access to the relative carriage 21, 22 for the hooking to the corresponding web 2, 3; this can be done without disturbing the operation of structure 19, 20 not affected by the hooking of the new web.

Each structure 19, 20 also comprises, on the side opposite to that adjacent to the segments 2*a*, 3*a* to be spliced of webs 2, 3, a plate 35, 36, which extends orthogonally between the rear edges of the relative plates 30 and 31 and whose function will be clarified in the following.

With reference to FIGS. 3, 5, 6, 7, 8 and 9, the carriage 21 comprises essentially a front wall 40 intended to cooperate with the segment 2*a* of the web 2 and extending parallel to the segment 2*a* itself, and a pair of protruding portions 41 extending perpendicularly cantilevered respectively from one upper end portion and a lower end portion of the front wall 40, from the side of the latter opposite to that cooperating with the web 2.

The carriage 21 comprises a further protruding portion 43 extending perpendicularly cantilevered from a intermediate portion of the front wall 40 from the same side of the protruding portions 41 and fixed to a motorized conveyor 44 in turn carried by the structure 19.

In particular, the conveyor 44 comprises a flexible transport element 45, in the example shows a toothed belt, looped around respective pulleys 46*a*, 46*b*, also toothed, mounted in a rotatable way on respective uprights 32 of the structure 19. More precisely, one of the pulleys (46*a*) is mounted on the upright 32 defining the hinge axis D of the structure 19, while the other pulley (46*b*) is mounted on an upright 32 arranged in a position adjacent to the rollers 33; the pulley 46*a* is motorized, in the sense that is splined to the output shaft (not visible in the attached figures) of an electrical motor 38 located in use below the plate 30 of the structure 19 and the table 12; the transport element 45 has an active branch 45*a* parallel to the overlapping segments 2*a*, 3*a* of the webs 2, 3 to be spliced and fixed to the protruding portion 43 of the carriage 21.

With particular reference to FIGS. 5, 6, 7, 8 and 9, the protruding portions 41 are provided, on the side opposite to that fixed to the front wall 40, of respective cam-following rollers 42 adapted to slidingly cooperate, during the movement of the carriage 21 in a parallel way to the segment P1 of path P, with respective cams 39, equal to each other, formed on the plate 35 of the structure 19 and adapted to maintain the carriage 21 itself in a front coupling condition with the carriage 22. Each cam 39 is constituted by an embossed element fixed cantilevered on the plate 35 and has, proceeding along the advancing direction of the webs 2 and 3, i.e. along the path P:

- a ramp ascending upstream segment 39*a*, slanting with respect to the webs 2 and 3 and directed towards the latter for determining an approach movement of the carriage 21 to carriage 22;
- a main segment 39*b* parallel to the webs 2 and 3; and
- a ramp descending downstream segment 39*c* slanting with respect to the webs 2 and 3 and diverging from the latter for determining a distancing movement of the carriage 21 from the carriage 22 so as to allow, once the splicing is performed, the free drawing of webs 2, 3 by the roller 13.

The front wall 40 has, in proximity of its downstream edge with reference to the path P, a rectilinear strip slit 47 parallel to the axes A, B, C, D and E and having the function of allowing the hooking of the head end of the web 2, when said web represents a new web.

The front wall 40 is also provided with through holes 48 selectively connectable to a vacuum source (not shown) to generate in use a vacuum adapted to determine the adhesion of the second segment of the web 2 to the front wall 40 itself.

The front wall 40 has, finally, a substantially central slit 49, also shaped as a rectilinear strip and extending parallel to the slit 47. As shown in FIGS. 5, 6, 7, 8 and 9, the slit 49 completely crosses the front wall 40 so as to allow the action of the cutting device 23 on the webs 2 and 3, as will be explained in detail below.

With reference to FIGS. 5, 6, 6*a*, 7, 7*a*, 8, 8*a*, 9 and 9*a*, the cutting device 23 comprise a support element 50 carried by the carriage 21 in a sliding manner in a direction F perpendicular to the segments 2*a*, 3*a* of the webs 2, 3 to be spliced, and a knife 51, in this case shaped like a thin plate, engaging in sliding manner along the direction F, the slit 49 of the front wall 40 of the carriage 21.

In particular, the knife 51 extends orthogonally to the segments 2*a*, 3*a* of the webs 2, 3 to be cut and is movable along the direction F between an advanced position (FIGS. 6 and 6*a*), wherein it projects from the front wall 40 to perform the cutting operation, and a retracted position (FIGS. 5, 7, 7*a*, 8, 8*a*, 9, and 9*a*), wherein it has its cutting edge placed in the slit 49.

The support element 50 comprises two arms 52 engaging in a sliding manner in the direction F respective protruding portions 41 of the carriage 21, and a bridge-like connecting portion 54 extending parallel and in a position facing the wall front 40, from the side of the latter opposite to that cooperating with the web 2.

The connection portion 54 is provided, on the side opposite to that facing the front wall 40, two cam following rollers 55, spaced and adapted to slidingly cooperate, during the movement of the carriage 21 parallel to the segment P1 of path P, with respective cams 56, equal to each other (only one visible in FIGS. 3, 5, 6, 7, 8 and 9), formed on the plate 35 of the structure 19. Each cam 56 is constituted by an embossed element fixed cantilevered on the plate 35 which run similarly as the cams 39, with an ascending ramp upstream segment 56*a*, a main segment 39*b* parallel to the segment P1 of the path P, and a descending ramp segment 56*c*, so that the cutting device 23 follow exactly the same movement of the carriage 21. Each cam 56 differs, however, from the cams 39 for the that it has, along the main segment 56*b*, a projection 57 adapted to determine the displacement of the support element 50 along the direction F with consequent movement of the knife 51 between the retracted position and the advanced position. In order to maintain, in any condition, the contact between the cam following rollers 55 and the cams 56, about arms 52 are wound respective helical springs 58, each of which acts between the connecting portion 54 and an annular shoulder formed in the seat of the relative protruding portion 41 wherein the relative arm 52 is engaged.

With reference to FIGS. 4, 5, 6, 7, 8 and 9, the carriage 22 essentially comprises a base wall 60 sliding on the base plate 30 of the structure 20, a top wall 61 adjacent to the upper plate 31 of the structure 20, a front wall 62 adapted to cooperate with the web 3, and a rear wall 63 facing the plate 36 of the structure 20 itself. The carriage 22 is therefore opened on opposite sides.

Figure 10:
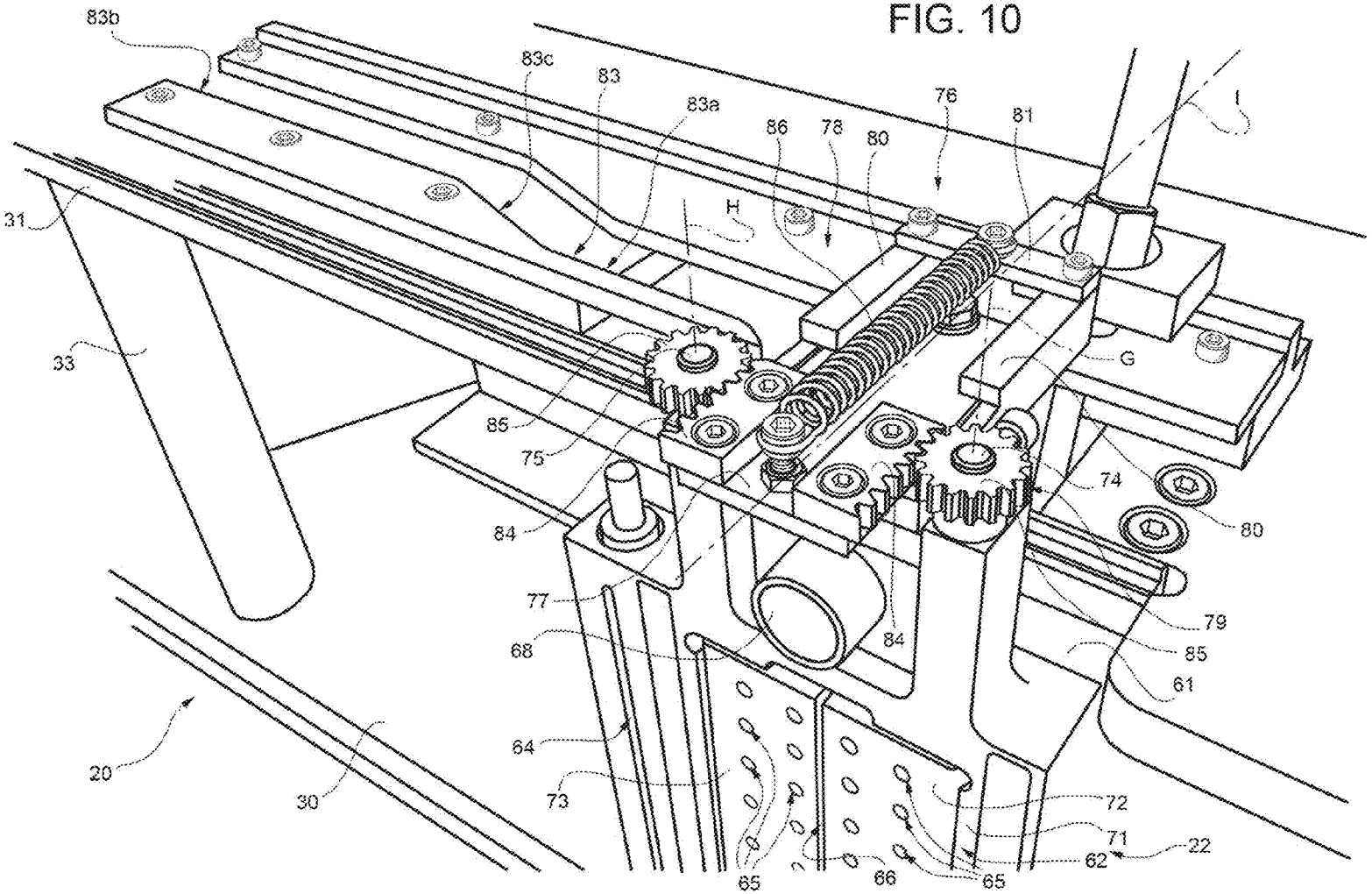
FIGS. 10 and 11 illustrate, in two different perspective views and on an enlarged scale, a detail of the component of FIG. 4.
Figure 11:
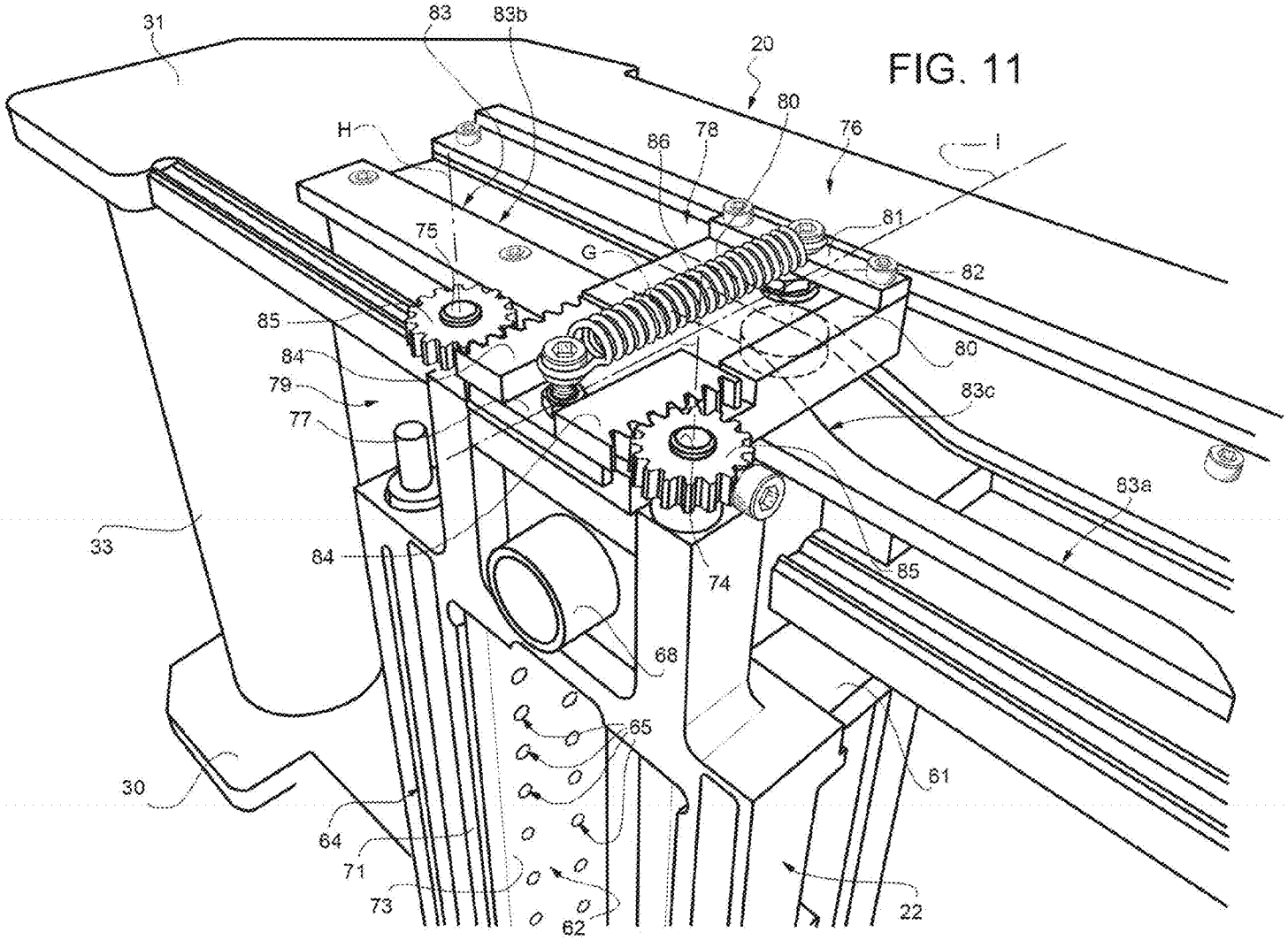
Figure 12B:
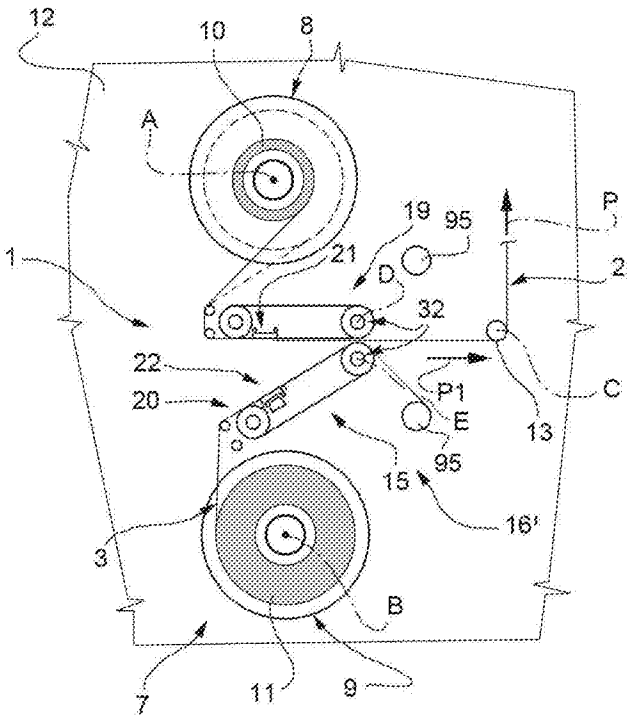
FIGS. 12*a*, 12*b*, 12*c* and 12*d* are similar to respective FIGS. 1*a*, 1*b*, 1*c* and 1*d* and illustrate schematically a top view of a possible variant of the splicing device according to the present invention, in different operating conditions within a labeling station.
Figure 12A:
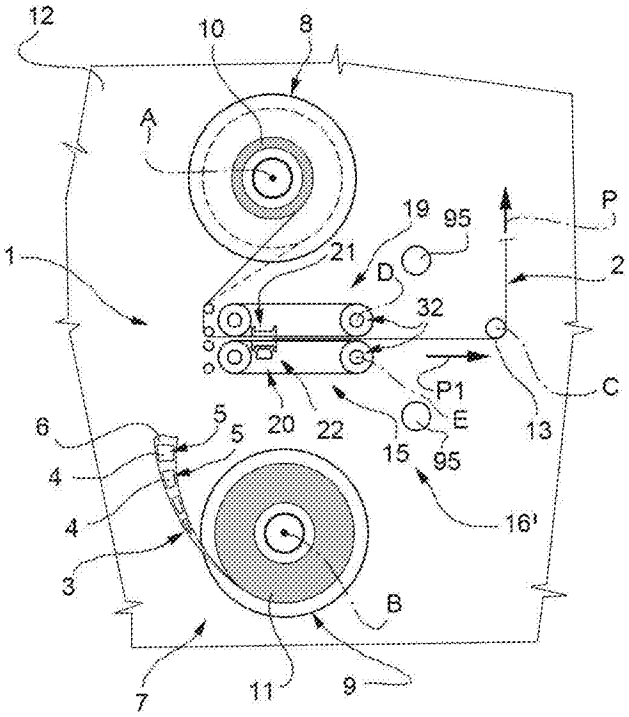
Figure 12D:
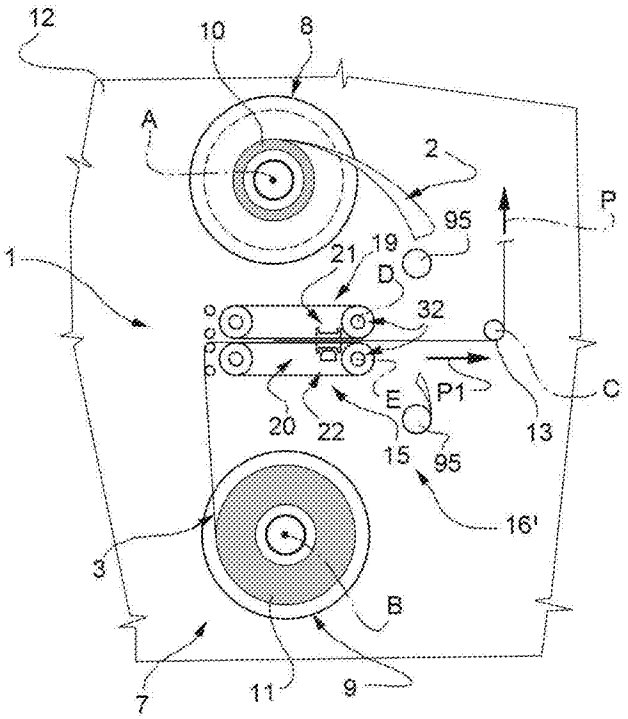
Figure 12C:
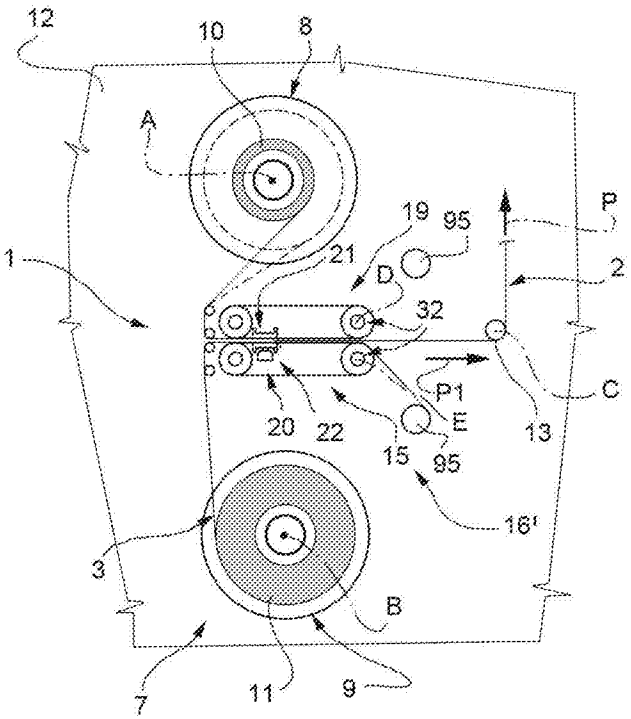

As can be seen in particular in FIGS. 10 and 11, the front wall 62 protrudes upward with respect to the top wall 61.

In a similar way to the carriage 21, the front wall 62 of the carriage 22 has, in the vicinity of its downstream edge with reference to the path P, a rectilinear strip slit 64 parallel to the axes A, B, C, D and E and having the function of allowing the hooking of the head end of the web 3, when said web represents the new web.

Also in this case, the front wall 62 is provided with through holes 65 selectively connectable to a vacuum source (not shown).

The front wall 62 has, in addition, a substantially central slit 66, also shaped as a rectilinear strip, extending parallel to slit 63 and adapted to allow the engagement of the knife 51 during the cutting action of the webs 2 and 3.

With particular reference to FIGS. 3 and 4, the front wall 62 is provided, also, at the bottom and above, of a first and a second engagement element 67, 68 adapted to couple with the complementary engagement elements 69, 70 carried by the front wall 40 of the carriage 21 to allow the dragging of the carriage 22 along segment P1 of the path P by way of the carriage 21 itself.

The engagement elements 67, 68, 69, 70 are formed in protruding position with respect to respective front walls 62, 40 and are alternately consisting of masculine elements and feminine elements; in particular, in the example shown, the engaging elements 67 and 70 are masculine elements, while the engaging elements 68 and 69 are feminine elements.

The overlapping segments 2*a*, 3*a* of webs 2, 3 are then maintained in contact with each other along the segment P1 of the path P by the coupling between the carriages 21 and 22.

With particular reference to FIGS. 4, 5, 6, 7, 8, 9, 10 and 11, the front wall 62 comprises an external frame 71 fixed to the base and to the top walls 60, 61, and a pair of doors 72, 73, which have first vertical edges, adjacent and delimiting from each other the slit 66, and second opposing vertical edges, hinged to the frame 71 about respective pins 74, 75 having axes G, H vertical and parallel to the axes A, B, C, D and E.

The doors 72, 73 are thus adapted to rotate in use about their respective axes G, H, towards the inside of the carriage 22 in such a way that, by selective activation of the connection to respective holes 65 to the vacuum source, can determine alternatively the folding of the downstream portion 25 of the web 3, when, as in the example illustrated, said web represents the new web, or the upstream portion 24 of the web 3 itself, when said web represents the web in use just before the exhaustion.

The holes 65 of the door 71, 72 not used for the function of folding are instead connected to a source of under pressure air (in itself known and not illustrated) to keep adhering to the web 2 the portion of the web 3 intended to be connected to the latter, namely the upstream portion 24 of the web 3, when said web represents a new web, or the downstream portion 25 of the web 3 itself, when said web represents the web in use just before the exhaustion.

In order to accomplish the rotation of the doors 72, 73, the carriage 22 is provided with actuator device 76 which can be activated by the movement of the carriage 22 itself parallel to the segment P1 of the path P.

In particular, the actuator device 76 comprise a movable element 77 carried by the carriage 22 so as to be able to translate along a direction I orthogonal to the overlapping segments 2*a*, 3*a* of the webs 2, 3 and parallel to the direction F, a cam assembly 78 adapted to transform the rectilinear motion imparted to the carriage 22 in a direction parallel to the segment P1 of the path P in a displacement of the movable element 77 along the direction I, and a transmission assembly 79 for transforming the translational motion of the movable element 77 in rotary motion of the doors 72, 73.

More precisely, the movable element 77 is defined by a plate-shaped sled and slidingly coupled between two guide elements 80 upperly extending cantilevered from the front wall 62 in an overlapping position to the upper wall 61 and parallel to the direction I; the guide elements 80 are also spliced together, in correspondence to their free ends, by a bridge-like element 81 parallel to and facing the front wall 62.

The cam assembly 78 comprises a cam following roller 82 inferiorly carried cantilevered by the bridge-like element 77 and adapted to couple in a sliding manner with a cam 83 fixed to the upper plate 31 of the structure 20. As shown in FIGS. 10 and 11, the cam 83 is defined by a through-shaped groove having two segments 83*a*, 83*b*, respectively upstream and downstream, parallel to the segment P1 of path P, and an intermediate segment 83*c* slanting with respect to the segment P1 itself, in this case illustrated, the upstream segment 83*a* is placed at a distance less from the front wall 62 with respect to the downstream segment 83*b* and the segment 83*c*, connecting the segments 83*a* and 83*b*, therefore allowing a distancing of the movable element 77 from the front wall 62. The transmission assembly 79 comprises a pair of racks 84 upperly fixed on the movable element 77 and meshing with corresponding sprockets 85 splined on the upper end portions of respective pins 74, 75, protruding upwards with respect to the front wall 62.

The translation along the direction I of the movable element 77 then determines a corresponding translation of the racks 84 with consequent rotation of 90° of the sprockets 85 and the pins 74, 75 angularly coupled thereto about respective axes G, H; the rotation of the pins 74, 75 then produces an identical rotation of the doors 72, 73 about the same axis G, H to the inside of the carriage 22.

A cylindrical helical spring 86, having an end fixed on the bridge-like element 81 and an opposite end fixed on the movable element 77, is adapted to maintain the movable element itself, in the absence of interaction between the cam following roller 82 and the cam 83, in a first operating position, wherein it locks the doors 72, 73 in a closing position wherein they cooperate, respectively, with the upstream portion 24 and with the downstream portion 25 of the web 3; the action of the segment 83*c* of the cam 83 on the cam following roller 82 is adapted to determine the displacement of the movable element 77 against the action of the spring 86 in a second operative position, wherein it maintains the doors 72, 73 rotated towards the inside of the carriage 22 in an open position.

With reference to FIGS. 5, 6, 7, 8 and 9, the applicator 27 comprise a buffer-carrier element 88 housed in movable manner inside the carriage 22 between the front wall 62 and rear wall 63 and along a direction L parallel to the directions F and I, and a support element 89 arranged outside of the carriage 22, by the opposite side of the rear wall 63 with respect to the front wall 62, and connected to the buffer-carrier element 88 by way of a pair of rods 90 extending parallel to the direction L and slidingly engaging the respective through holes formed in the rear wall 63 itself.

In particular, the buffer-carrier element 88 is essentially consisting of a block substantially parallelepiped intended to receive the buffer 28 on its own front face provided with through holes (not visible in the attached figures) selectively connectable to a vacuum source so as to retain the buffer 28 itself by vacuum.

The buffer-carrier element 88 is movable along the L direction between a retracted position (FIGS. 5, 6 and 7), which has its front face spaced by a predetermined quantity from the doors 72, 73 arranged in the closed position, and an advanced application position (FIGS. 8 and 9), wherein it engages the space vacated by the doors 72, 73 in the opening position and allows the buffer 28 to adhere on the adjacent ends of the downstream portion 25 of the web in use, in the example shown the web 2, and the upstream portion 24 of the new web, in the example shown the web 3.

The support element 89 is substantially plate shaped and is provided, on the side opposite to that facing the rear wall 63 of the carriage 22, of two cam following rollers 91 (only one of which visible in FIGS. 5, 6, 7, 8 and 9), spaced one from the other and adapted to slidingly cooperate, during the movement of the carriage 22 in a parallel way to the segment P1 of path P, with respective cams 92, equal to each other (only one visible in FIGS. 3, 5, 6, 7, 8 and 9), formed on the plate 36 of the structure 20.

Each cam 92 is constituted by an embossed element fixed cantilevered on the plate 36 and has two segments 92*a*, 92*b*, respectively upstream and downstream, parallel to the segment P1 of path P, and an intermediate segment 92*c* slanting with respect to the segment P1 itself converging towards the latter in the advancing direction of the carriage 22; in the example shown, the upstream segment 92*a* is placed at a greater distance from the rear wall 63 of the carriage 22 with respect to the downstream segment 92*b* and the segment 92*c*, connecting the segments 92*a* and 92*b*, therefore, allows the movement of the buffer-carrier element 88 from the retracted position to the advanced position; the extension of the segments 92*a* and 92*b* in parallel to the segment P1 of path P is chosen so that the movement of the buffer-carrier element 88 from the retracted position to the advanced position will begin after the rotation of the doors 72, 73 in the open position.

In order to maintain, in every condition, the contact between the cam following rollers 91 and the cams 92, between the support element 89 and the rear wall 63 of the carriage 22 two helical springs 93 are interposed extending parallel and adjacent to the respective rods 90.

The operation of the device 1 is described starting from an initial condition (FIG. 1*a*), wherein the web 2 is unwound from the reel 10 and is fed toward the labeling machine by the roller 13, while the new web 3 is completely wound to form the reel 11.

Just before the exhaustion of the reel 10, the structure 20 is rotated about the axis E in a counterclockwise direction in FIG. 1*b* so as to distance it from the structure 19 and make the carriage 22 accessible.

Figure 1C:
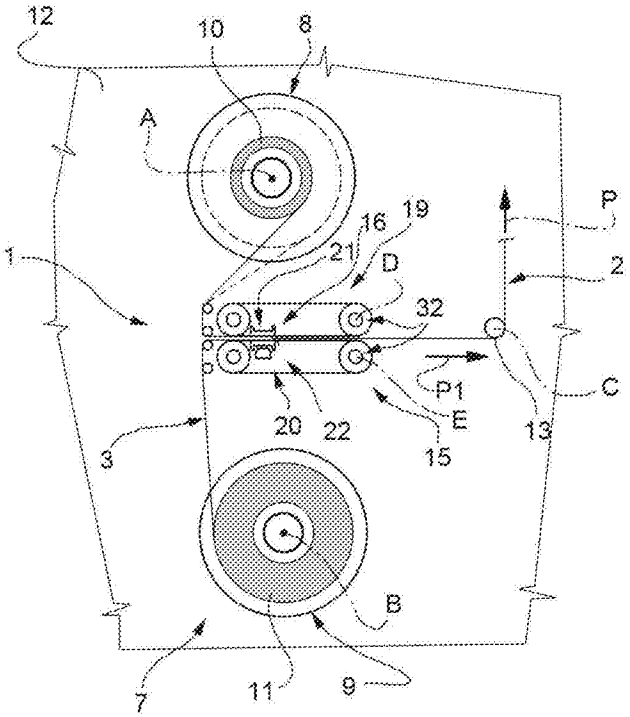

At this point (FIG. 1*b*), the head end of the new web 3 is engaged and fixed in the slit 64 of the carriage 22 and the structure 20 is then brought back into the initial position adjacent to the structure 19 so that the webs 2 and 3 will result overlapping in correspondence of their own segments 2*a* and 3*a* (FIGS. 1*c* and 2). It can therefore start an advancement step of the webs 2 and 3 at the same speed by way of a joint movement of the two carriages 21 and 22. In particular, the carriage 21, integral with the segment 45*a* of the transport element 45 moves integrally with the latter along the segment P1 of the path P, while the carriage 22 is dragged by the carriage 21 by way of coupling of the engagement elements 67, 68 with the engaging elements 69, 70. During the passage along the segment 39*a*, the carriage 21 further approaches the carriage 22 so that the overlapping segments 2*a*, 3*a* of the webs 2, 3 will result pressed from opposite sides from the carriages 21, 22 themselves.

Figures 5, 5A:
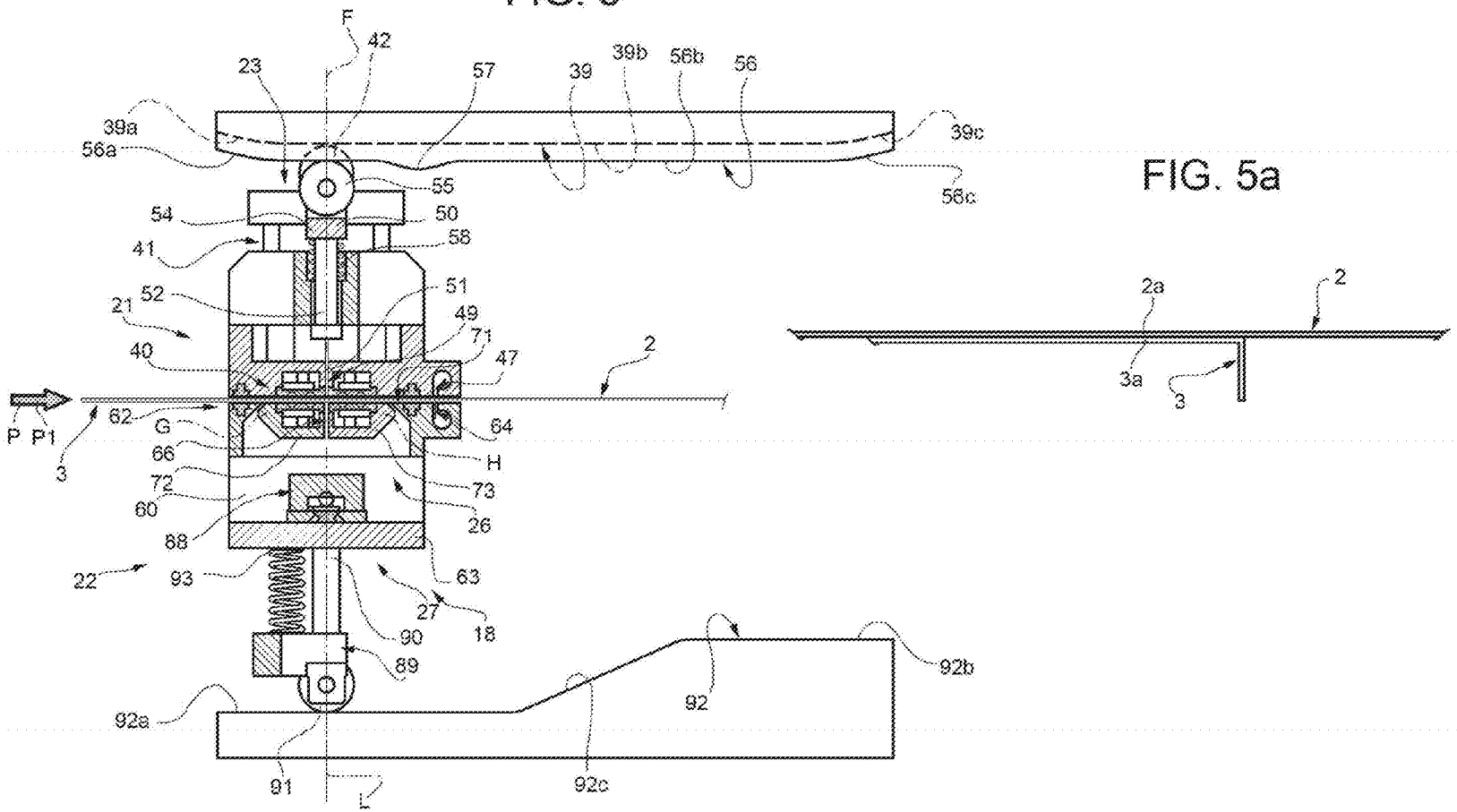
FIGS. 5, 6, 7, 8 and 9 are sections, on a reduced scale and with parts removed for clarity, taken according to the line V-V of FIG. 2 and illustrating the splicing device object of the invention in various operating conditions.
FIGS. 5*a*, 6*a*, 7*a*, 8*a* and 9*a* illustrate schematically, in top view and on an enlarged scale, the two webs to be spliced during the operational steps of the splicing device represented in FIGS. 5 to 9.
Figures 6, 6A:
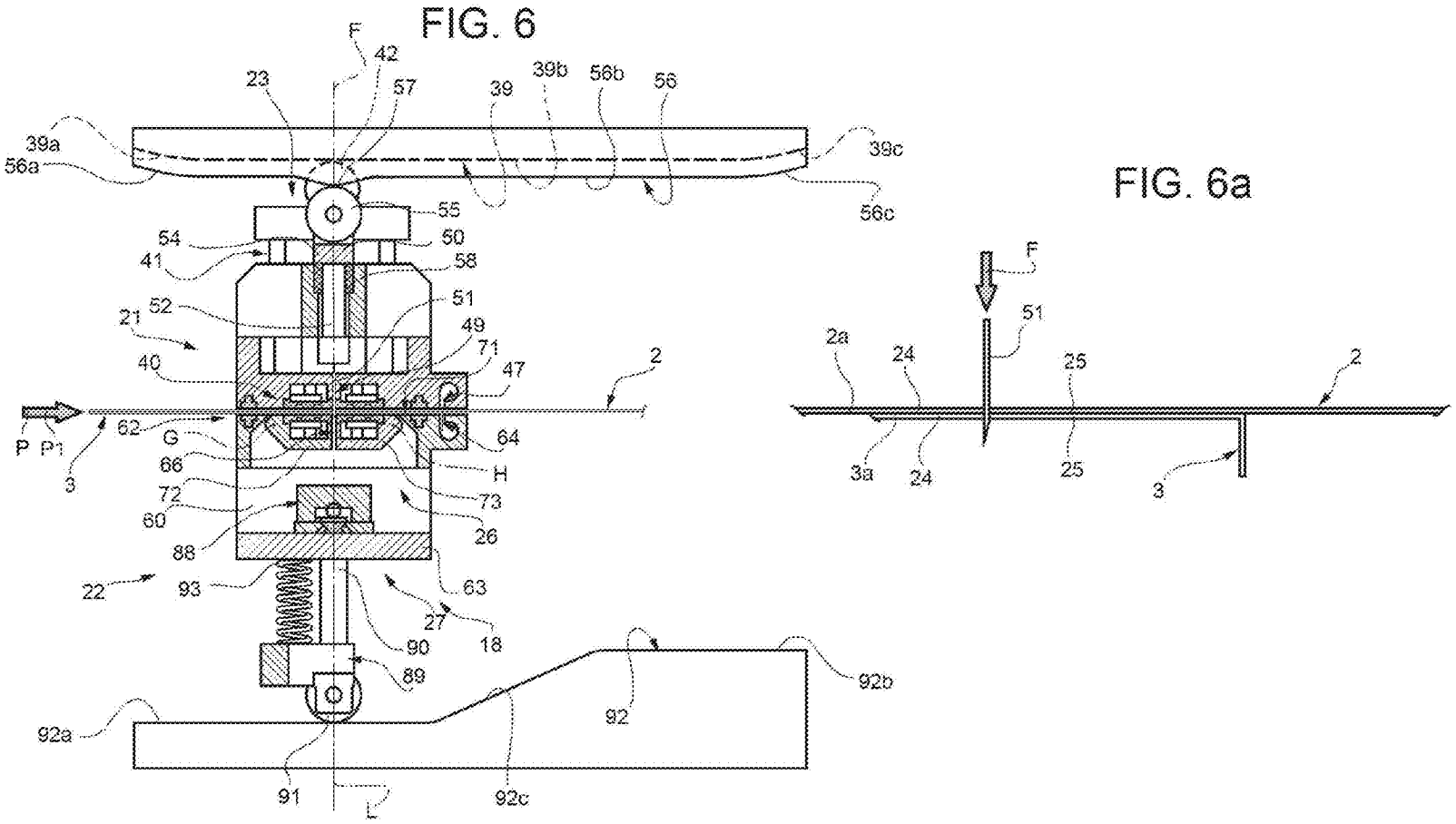

As soon as the cam following rollers 55 reach the projections 57 of respective cams 56, the support element 50 and the knife are moved with respect to the carriage 21 along the direction F towards the overlapping segments 2*a*, 3*a* of the webs 2, 3; in particular, the knife 51 is moved from the retracted position of FIG. 5 to the advanced position of FIG. 6, so as to be able to perform the cutting operation on both segments 2*a*, 3*a* of the webs 2, 3 (FIG. 6*a*). Once passed the projections 57, the knife 51 returns, together with the support element 50, in the retracted position, pushed by the action of springs 58 (FIGS. 7 and 7*a*).

At the end of this step, each of the webs 2 and 3 is divided into an upstream portion 24 and into a downstream portion 25, arranged respectively upstream and downstream of the cutting area with reference to the path P.

Subsequently the cutting operation, the cam following roller 82 of the movable element 77 engages the intermediate segment 83*c* of the cam 83 moving consequently along the direction I in order to distance itself from the front wall 62 of the carriage 22; as a result of said movement the racks 84 are moved parallel to the direction L together with the movable element 77, by determining, by way of meshing with the respective spools 85, the rotation of the pins 74, 75 about respective axes G, H; the doors 72, 73 then also rotate about the axes G, H until reaching the open position (FIGS. 7, 8, 9 and 11).

Figures 7, 7A:
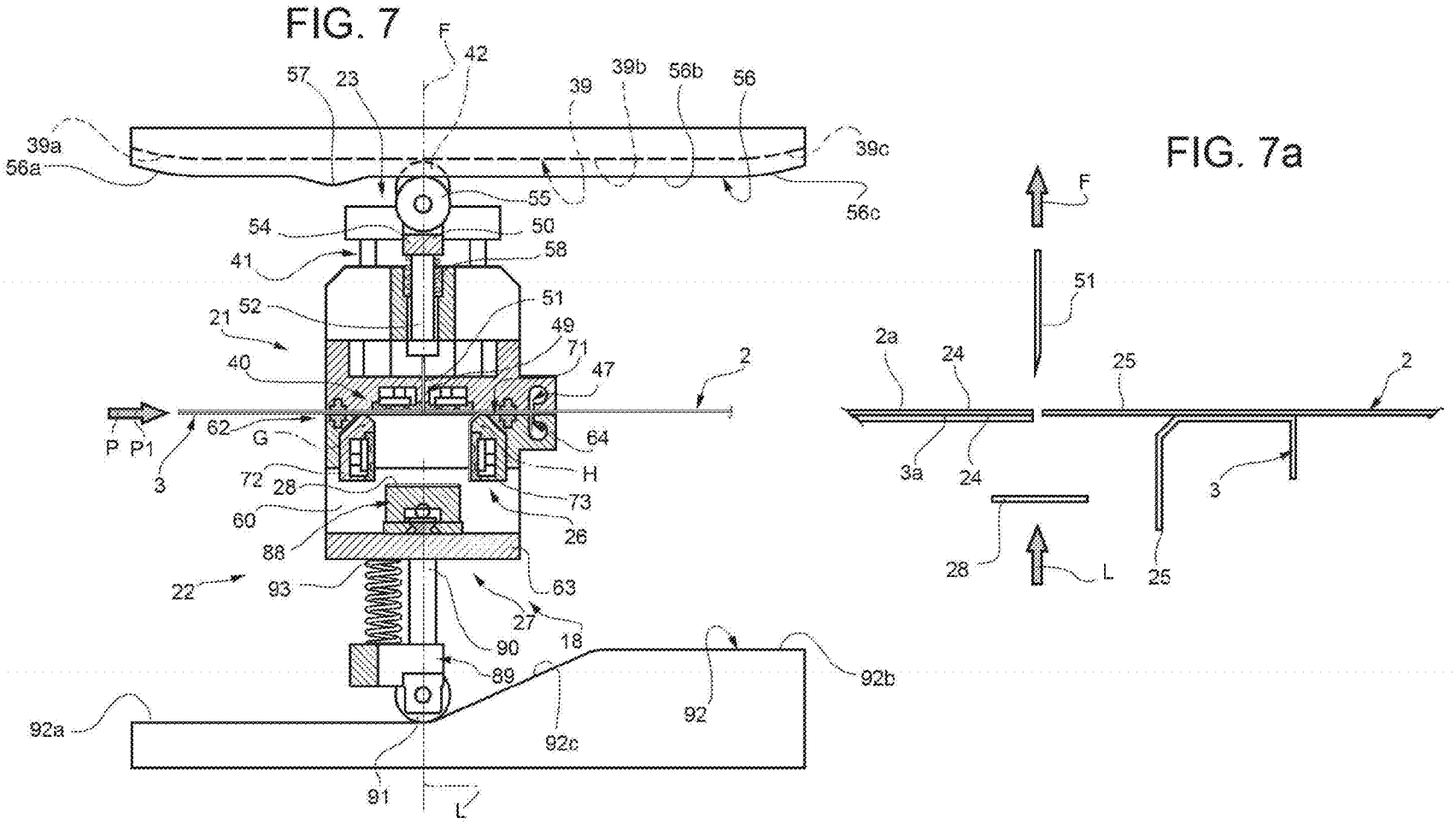

During said step, the holes 65 of the door 72, 73 adjacent to the portion of the web 3 which is unnecessary to perform the splicing between the webs 2 and 3, in the example shown the door 73 adjacent to the downstream portion 25 of said web, are connected to the vacuum source; in this way, the rotation of the door 73 determines the folding, outside of the overlapping area of the webs 2 and 3 themselves, from the flap of the downstream portion 25 of the web 3 adjacent to the cutting area (FIGS. 7 and 7*a*).

In the case wherein the web 3 will be the web in use, the action of folding should be conducted on the upstream portion 24 of said web; and therefore, in this case, the vacuum source will be connected to the holes 65 of the door 72.

In both cases, the folding of the portion of the web 3 which is unnecessary for the splicing of said web to the web 2 is performed by generating a flow of fluid on the above-mentioned portion, in the example shown air.

At the same time, the holes 65 of the door 72, 73 not used for the function of folding, in the example shown the door 72, are instead connected to the source of under pressure air to keep the portion of the web 3 intended to be connected to said latter adhered to the web 2, in the example shown the upstream portion 24 of web 3; if the new web were instead represented by the web 2, the holes 65 of the door 73 would instead be connected to the source of under pressure air to maintain the downstream portion 25 of the web 3, which in this case would be the web in use, in the unfolded condition.

Figure 8A:
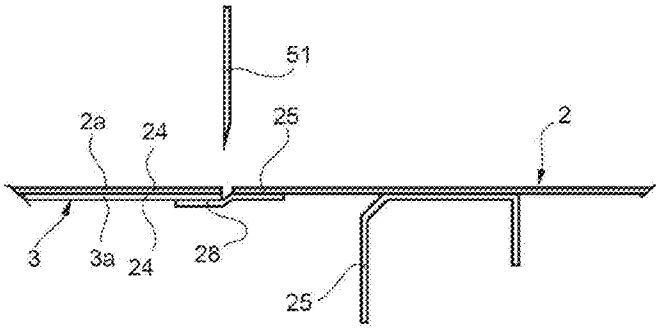
Figure 8:
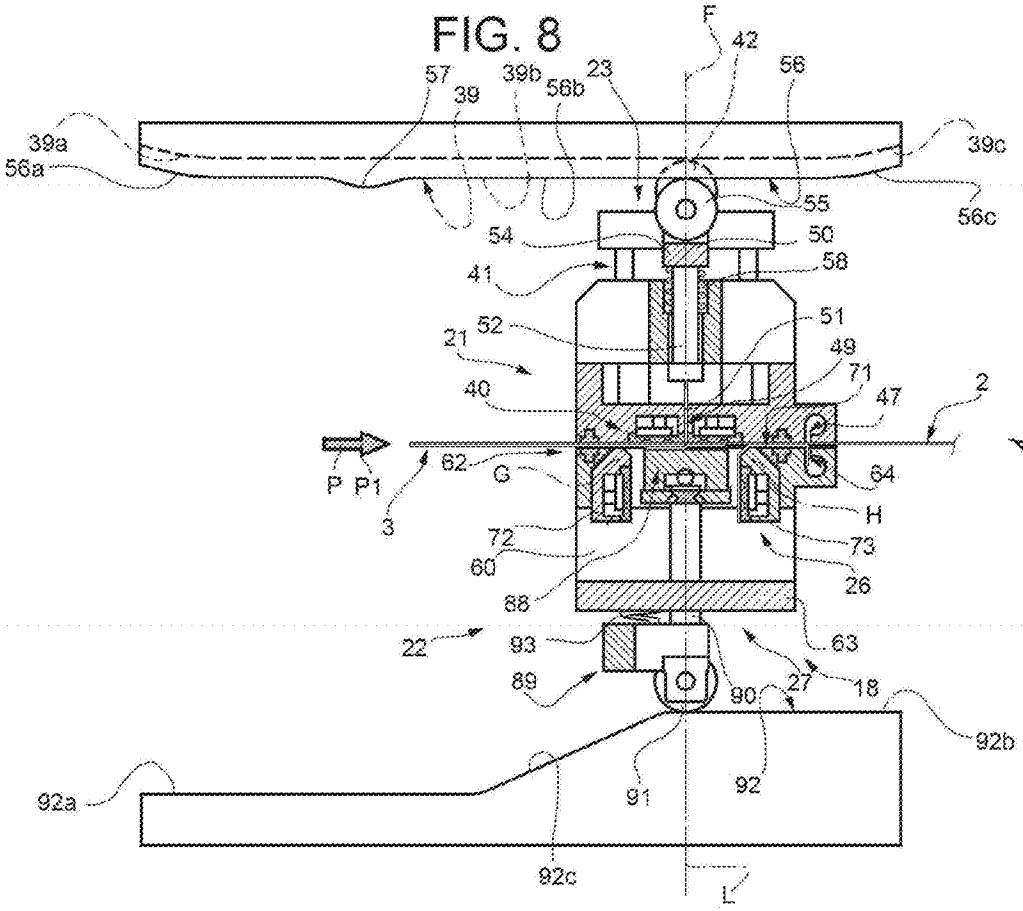
Figure 9A:
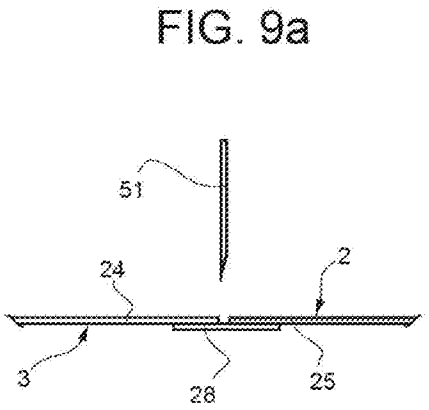
Figure 9:
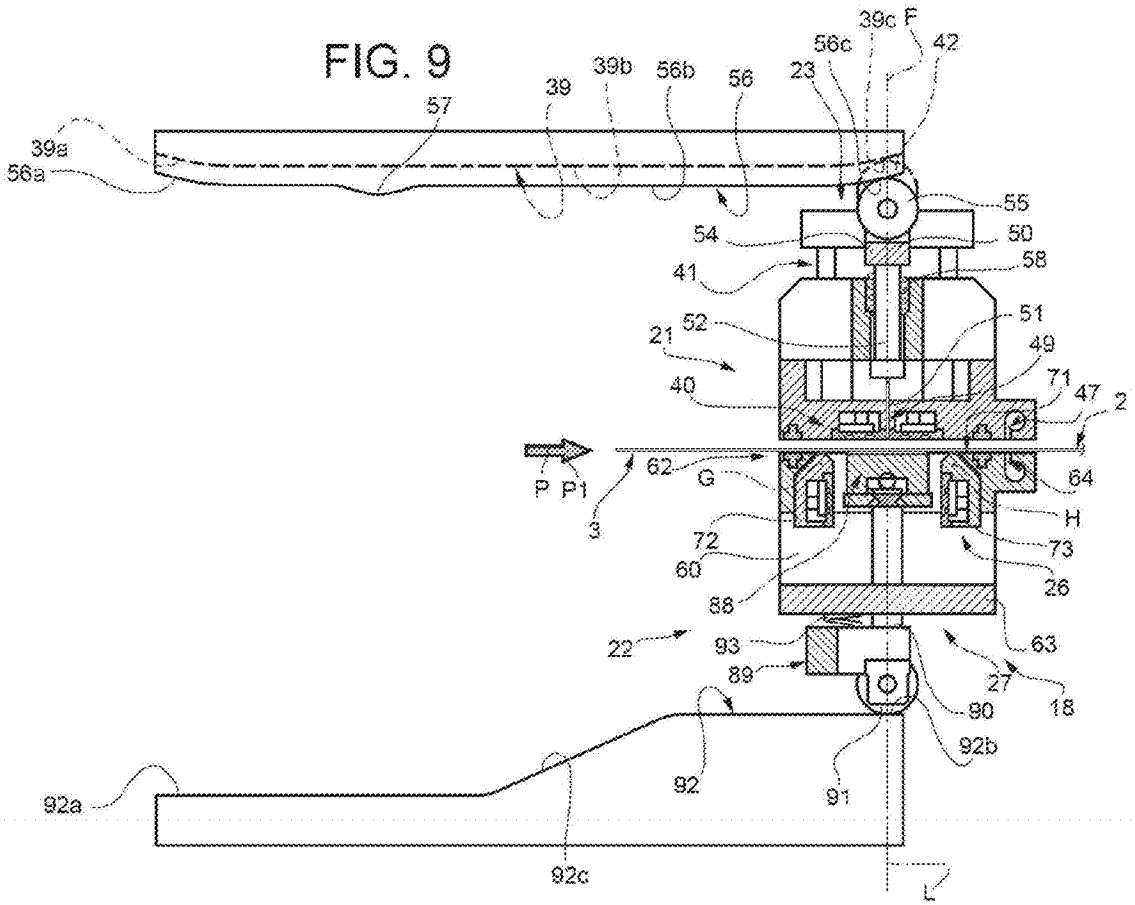

At this point, the cam following rollers 91 reach the intermediate segments 92*c* of the cams 92 thus determining the displacement of the buffer-carrier element 88 and the support element 89 from the retracted position of FIG. 7 to advanced position of FIGS. 8 and 9 with consequent application of the buffer 28 on the adjacent ends of the downstream portion 25 of the web 2, no longer covered by the downstream portion 25 of the web 3, and the upstream portion 24 of the web 3 itself in order to connect together said ends head to head, i.e. without any overlapping between the ends themselves (FIGS. 8*a* and 9*a*).

The carriage 21, finally, is slightly distanced from the carriage 22 by the passage effect of the cam following rollers 42 along segments 39*c* of the respective cams 39.

The new web 3 is thus connected to the exhausting web 2 and the two webs 2, 3 can then again be fed to the labeling machine under the same conditions performed before the splicing operation; the portions of the webs 2 and 3 not connected by the buffer 28, in the example shown the downstream portion 25 of the new web 3 and the upstream portion 24 of the web 2 in use, are therefore withdrawn from the device 1 enabling the feeding to the labeling machine of the two webs 2 and 3 spliced head to head by the buffer 28 and not having overlapping parts (FIG. 9*a*).

In FIGS. 12*a*, 12*b*, 12*c* and 12*d*, is indicated as a whole with 16' a possible variant of the handling assembly of the device 1, which will be described below only insofar as it differs from the handling assembly 16, and indicating with the same reference numbers parts identical or equivalent to those already described.

In particular, the handling assembly 16' differs from the handling assembly 16 essentially for the fact that it comprises, on each side of the path P, a relative motorized roller 95 adapted to receive the head end of the respective web 2, 3, when said web is the new web.

The rollers 95 are arranged externally to the carriages 21, 22 and downstream of the latter with reference to the path P.

In the feeding step of the new web, in the example shown the web 3, to the device 1, said web crosses the entire structure arranged at the same side of the new web itself, in the example shown the structure 20, and is fixed to the relative roller 95 which will advance it at the same speed of the web in use, in the example shown the web 2.

In this case, the carriages 21, 22 perform essentially the function to keep the overlapping segments 2*a*, 3*a* of the webs 2, 3 adhering to each other.

From an examination of the characteristics of the device 1 and of the splicing method according to the present invention are evident the advantages that it allows to obtain.

In particular, the splicing method described allows to connect the cut ends of the two webs 2, 3 head to head without any overlapping between the same; in this way, it is not necessary to discard any container at the end of the production cycle due to incorrect labeling.

In addition, the splicing zone has a thickness less than the thickness of the splicing area obtainable with the known techniques, wherein there is a partial overlapping of the two webs to be joined. This facilitates the management of the subsequent detachment of labels 5 from the relative strip support 6, without any risk that the buffer 28, arranged on the side opposite to that on which the labels 5 are arranged, could also be detached from the webs 2, 3 connected thereof.

Finally, it was noted that the splicing method described allows to maintain the pitch between the labels 5 of the two webs 2, 3 after the splicing operation, and that this latter operation can be conducted at speed greater than that which takes place in traditional systems.

Finally, it is clear that the device 1 and the splicing method described and illustrated herein may be subject to modifications and variations which do not depart from the scope defined by the claims.

The invention claimed is:

1. An apparatus for splicing a new web, provided with repeated patterns, to a web in use, also provided with repeated patterns, unwound from a respective reel and fed along a predetermined path towards a processing machine; said apparatus comprising:

an actuator device selectively driven for splicing a segment of said new web to a segment of said web in use one on top of the other in overlapping positions and with the corresponding patterns aligned; wherein said actuator device comprises:

a cutting device selectively activated to perform a cutting operation of said overlapping segments of said webs at the area interposed between two successive patterns to divide each web in two distinct portions upstream and downstream of the cutting area with reference to said path;

a folding device which can be selectively activated to fold, in the vicinity of said cutting area and outside of the overlapping area between said webs, one of an upstream portion of said web in use and the downstream portion of said new web formed by said cutting operation; and a applicator transversely movable to said path to apply a splicing buffer on the adjacent ends of the downstream portion of said web in use and of the upstream portion of said new web in order to connect to one another said ends head to head;

a handling assembly which can be selectively activated just before the exhaustion of said reel for advancing said new web at the same speed of said web in use and with said segments overlapped and aligned, wherein the handling assembly comprises a first and a second carriage arranged on opposite sides of said webs, jointly movable in a direction parallel to at least a segment of said path and adapted to keep adhering to each other the overlapping segments of said webs.

2. The apparatus according to claim 1, wherein said cutting device, said folding device and said applicator are carried by at least one of said first and second carriage.

3. The apparatus according to claim 2, wherein said folding device are carried by said first carriage and which can be selectively activated to fold the upstream portion of the web adjacent to the first carriage when said web is the web in use or the downstream portion of the web adjacent to the first carriage when said web is the new web.

4. The apparatus according to claim 3, wherein said folding device comprises a pair of movable elements cooperating respectively with the upstream portion and with the downstream portion of the web adjacent to said first carriage and movable towards the inside of the first carriage itself to allow the folding operation.

5. The apparatus according to claim 4, wherein each of said movable elements has a plurality of through holes selectively connectable to a vacuum source independently from the holes of the other movable element for holding, during its own movement towards the inside of said first carriage, at least one flap of the portion of the web adjacent thereof so as to fold it on the outside of the overlapping area of said webs.

6. The apparatus according to claim 4, wherein each of said movable elements has a plurality of through holes selectively connectable to a vacuum source independent from the holes of the other movable element for directing, during its movement towards the inside of said first carriage, a jet of pressurized fluid on the portion of web adjacent to it and keeping it in an overlapping condition to the other web.

7. The apparatus according to claim 4, wherein said movable elements comprise respective doors hinged to said first carriage about respective axes parallel to the overlapping segments of said webs and transverse to said path, said movable elements being rotatable about said axes between a first operating position, wherein they respectively cooperate with the upstream portion and with the downstream portion of the web adjacent to said first carriage, and a second operating position, wherein they are rotated towards the inside of said first carriage and leave an empty space in correspondence to the cutting area and in the surrounding area of the same.

8. The apparatus according to claim 7, wherein said applicator comprises a buffer holding element housed on said first carriage in a movable way along a direction orthogonal to the overlapping segments of said webs between a retracted position, wherein it is spaced from said movable elements arranged in said first operational position, and an advanced application position, wherein it engages the space vacated by said movable elements arranged in said second operational position and brings the buffer to adhere upon both adjacent ends to be joined to the downstream portion of the web in use and the upstream portion of the new web.

9. The apparatus according to claim 2, wherein said cutting device comprises a knife carried by said second carriage and movable in a direction orthogonal to the overlapping segments of said webs.

10. The apparatus according to claim 2, comprising a cam configured so as to enable, during the movement of said first and second carriage, said cutting device of said first folding device and said applicator after said folding device.

11. The apparatus according to claim 1, wherein said handling assembly is defined by one of said first and second carriage provided with retention device for fixing one head end of said new web.

12. The apparatus according to claim 1, wherein said handling assembly comprises at least one motorized roller adapted to receive one head end of said new web and arranged externally to said first and second carriage.

13. The apparatus according to claim 1, comprising a conveyor device for advancing one of said first and second carriage parallel to said path, and a mutual coupling device between said first and second carriage to allow the dragging of the other of said first and second carriage by said one of said first and second carriage.

14. The apparatus according to claim 1, comprising a first and a second carrying structure arranged at opposite sides of the overlapping segments of said webs movably carrying respectively said first and second carriage and angularly movable about respective axes parallel to the webs themselves to allow the feeding of said new web in overlapping and aligned position with said web in use.

* * * * *